United States Patent [19]

Lancaster et al.

[11] 4,015,295

[45] Apr. 5, 1977

[54] DIVING SUIT AND NECK SEAL THEREFOR

[76] Inventors: Woodrow A. Lancaster, 207 S. Main St., Middleton, Mass. 01949; William T. Jebb, 88 Holly St., Gloucester, Mass. 01930; Alan M. Chagan, 25 Appleton Ave., Beverly, Mass. 01915

[22] Filed: Apr. 15, 1976

[21] Appl. No.: 677,217

[52] U.S. Cl. ..... 2/2.1 R

[51] Int. Cl.[2] ..... B63C 11/04

[58] Field of Search ..... 2/2.1 R, 2.1 A; 285/276, 367

[56] References Cited

UNITED STATES PATENTS

| | | | |
|---|---|---|---|
| 2,894,078 | 2/1946 | Krupp | 2/2.1 R |
| 3,112,130 | 11/1963 | Miller | 2/2.1 A X |
| 3,172,126 | 3/1965 | Spano et al. | 2/2.1 R |
| 3,534,408 | 10/1970 | Fifield | 2/2.1 R |
| 3,574,862 | 4/1971 | Jones | 2/2.1 R |
| 3,731,319 | 5/1973 | O'Neill | 2/2.1 R |
| 3,740,764 | 6/1973 | Elfstrom et al. | 2/2.1 R |

FOREIGN PATENTS OR APPLICATIONS

| | | | |
|---|---|---|---|
| 1,159,802 | 12/1963 | Germany | 2/2.1 R |
| 1,954,048 | 5/1970 | Germany | 2/2.1 R |

*Primary Examiner*—Alfred R. Guest

[57] ABSTRACT

A diving suit has a collar and the neck seal therefor has first and second elliptical rings, both of the same size and dimensioned to freely receive the head of the wearer. The first ring is the lower one and the upper end of a neck dam is clamped between the rings. The first ring has an external annular groove in which the collar of the suit is detachably secured by an encircling clamp which is also used to detachably secure and seal the dam of a helmet against the first ring.

10 Claims, 5 Drawing Figures

18
20
15
17
25
29
5
5
19
27
14
22
21
11
12
24
16
13
10
26

20
15
17
26

DIVING SUIT AND NECK SEAL THEREFOR

BACKGROUND REFERENCES

U.S. Pat. No. 3,172,126
U.S. Pat. No. 3,731,319
U.S. Pat. No. 3,740,764

BACKGROUND OF THE INVENTION

Diving suits of both the wet and dry type have been continuously improved as their use has become more widespread. Among the areas still meriting improvement are neck seals.

THE PRESENT INVENTION

The general objectives of the present invention are to provide improved neck seals and suits incorporating such seals, an objective attained with a diving suit having a rubber neck or collar and a neck seal detachably attached thereto.

The neck seal has first and second elliptical rings, both of the same size and dimensioned freely to receive the head of the wearer. The first ring is the lower one and the upper end of a neck dam is detachably clamped between the two rings. The first ring has an annular outer channel in which the collar of the suit is detachably secured by encircling, releasable, clamping means which is also used to secure and seal the dam of a helmet which overlies the collar.

A particular objective of the invention is to provide a suit having a pliable rubber neck with its upper edge in the form of a bead and with the neck including a shoulder portion sealed to the suit to close the neck opening.

Another objective of the invention is to provide a neck that ensures the security of the sealing of the collar of the suit and the helmet dam, an objective attained with the channel of the first ring dimensioned to receive between it the entire collar and the thickness of the dam of the helmet.

BRIEF DESCRIPTION OF THE DRAWINGS

A preferred embodiment of the diving suit and neck seal in accordance with the invention is illustrated by the accompanying drawings

THE PREFERRED EMBODIMENT OF THE INVENTION

Figure 1:
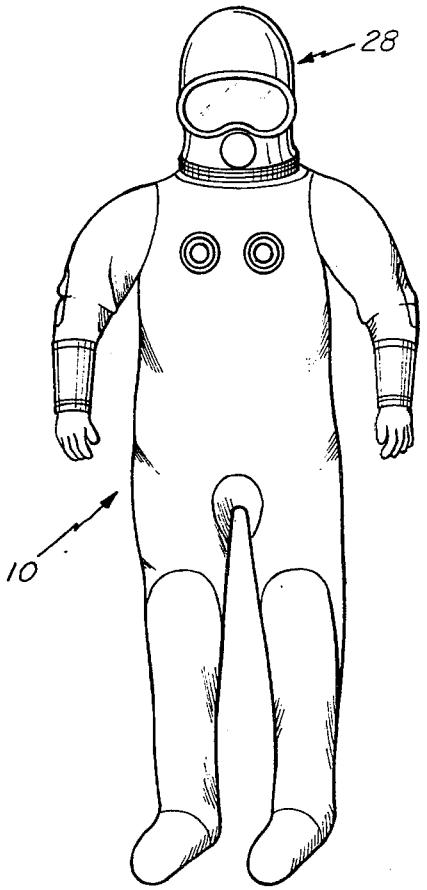
FIG. 1 is a front view thereof.

A constant volume diving suit is generally indicated at 10 and while it may be of any type, it features a collar 11 having a shoulder portion 12 closing the neck opening 13 of the suit and bonded to the margins thereof with an appropriate overlap. The upper edge of the collar 11 is in the form of a bead 14.

A neck seal in accordance with the invention is generally indicated at 15 and includes a first or lower ring 16 and a second or upper ring 17. Both rings are elliptical and of the same size and are dimensioned freely to receive the head of the wearer with their long axes corresponding to that of the head. The upper ring 17 has a series of bores 18 each dimensioned to register with an appropriate one of the tapped holes 19 in the upper part of the first ring 16 thus to receive screws 20 enabling the two rings to be detachably assembled as a unit.

While the second ring 17 is or may be quite thin, the first ring 16 is relatively thick, having a height of about an inch and a quarter by way of a preferred example. The ring 16 has an external peripheral channel 21 having its side walls inclined outwardly away from each other, the channel at its bottom being wider than the stainless steel, ring encircling band 22, the ends of which are detachably interconnected as by a toggle type buckle 23. In practice, the band 22 is of ½ inch stock.

A neck dam, generally indicated at 24, has an upper portion 25 and a downwardly extended and inwardly tapering neck-engaging portion 26. The upper edge of the portion 25 is an elliptical flange 27 having holes spaced in the same manner as the holes in the rings 16 and 17 and is clamped therebetween when the screws are suitably tightened.

The collar 11 is a snap-fit in the ring 16 with the bead 14 seated against and preferably protruding slightly from the outwardly and upwardly inclined upper wall of the channel 21 and the adjacent margin of the shoulder portion 21 seated on the downwardly and outwardly inclined lower wall of the channel 21.

Figure 2:
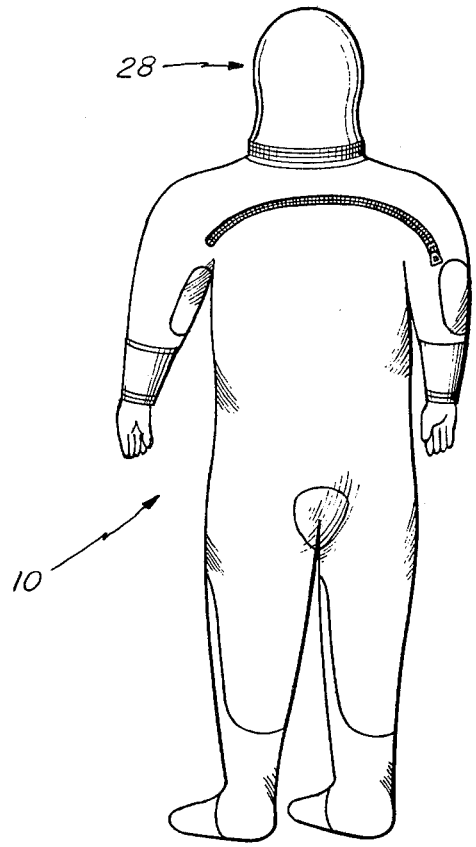
FIG. 2 is a view of the diving suit as seen from the rear.
Figure 3:
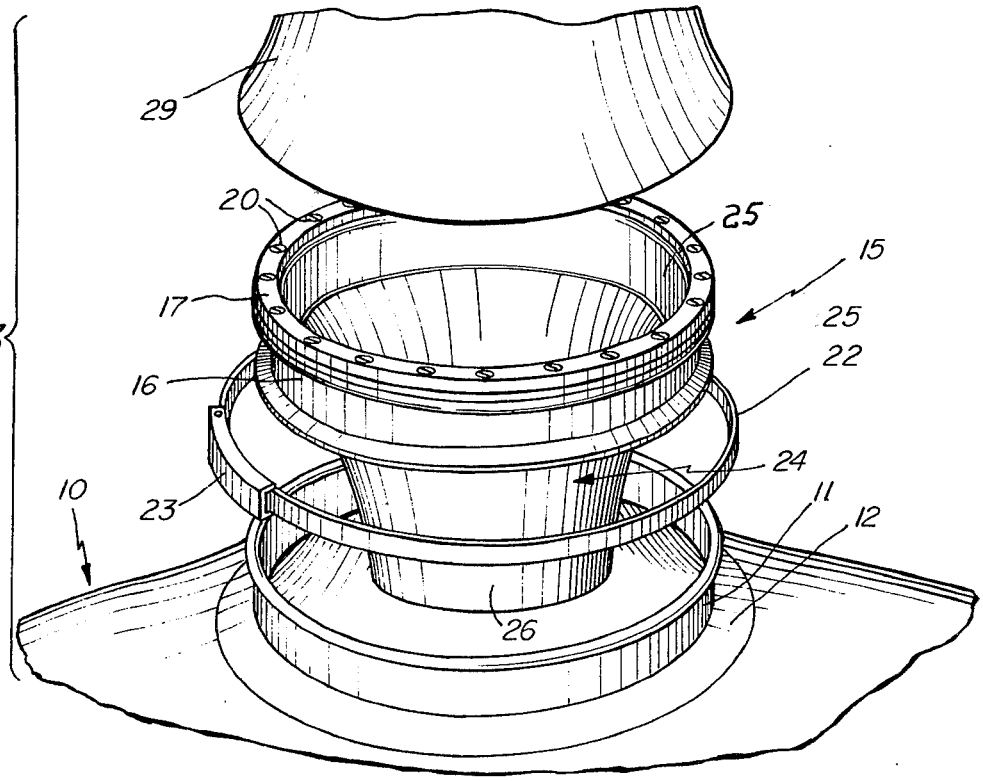
FIG. 3 is an exploded perspective view on an increase in scale of the neck seal.
Figure 4:
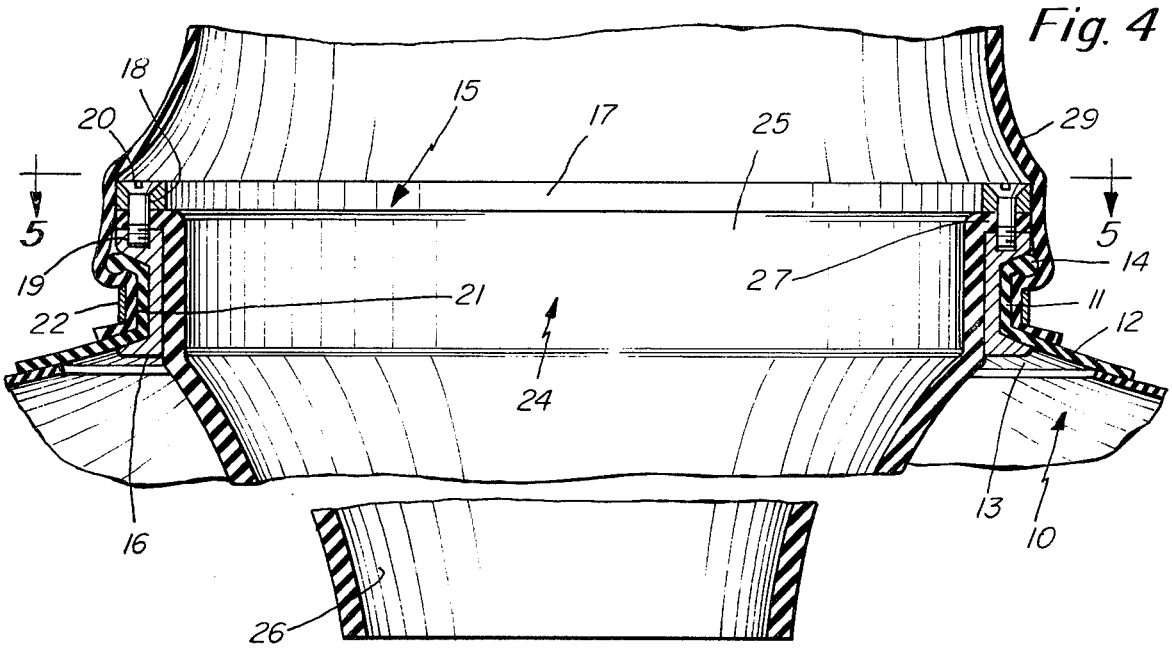
FIG. 4 is a section, on a further increase in scale, taken vertically through the neck seal with the collar of dress and the dam of a helmet secured thereto.
Figure 5:
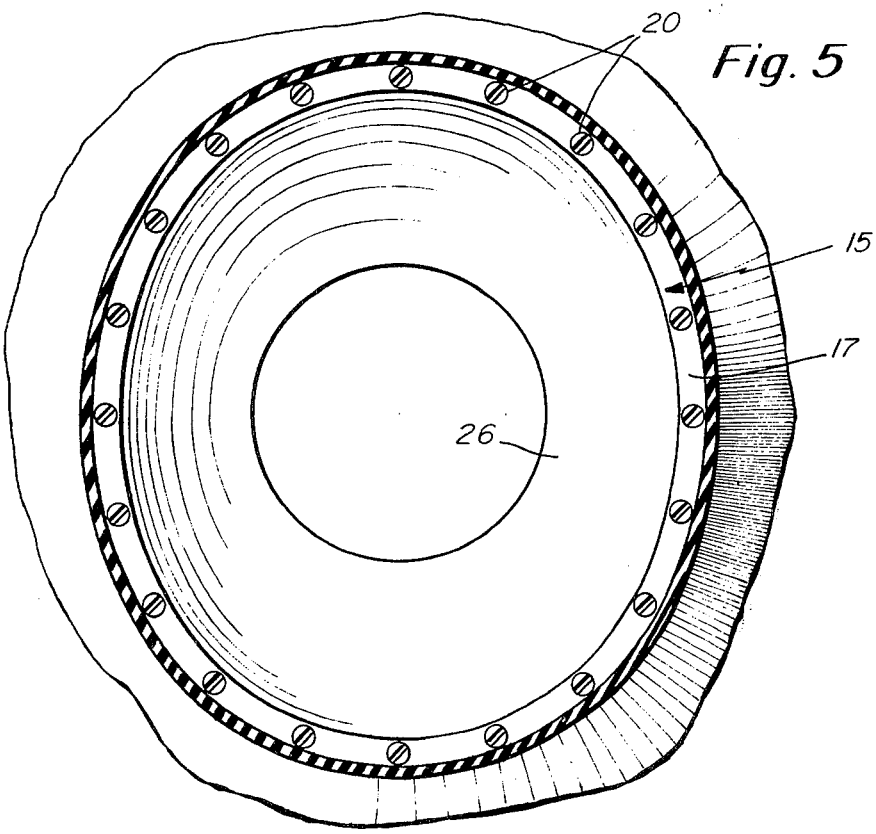
FIG. 5 is a section taken approximately along the indicated line 5—5 of FIG. 4.

The neck seal 15 is adapted for use with helmets 28 of a variety of types and, accordingly, that shown in FIGS. 1 and 2 is not detailed but a portion of a helmet dam is indicated at 29. In use, the helmet dam 29 is pulled downwardly over the collar and secured to the neck seal 15 by the band 22 when the buckle 23 is closed. The depth of the channel 21 is such that the band 22 is within it when tightened and locked about the neck collar 11 and the helmet dam 29.

We claim:

1. A diving suit for use with a helmet having a dam, said suit including a body section, a collar, and a neck seal, said neck seal including first and second rings dimensioned to permit the head of the wearer to pass freely therethrough and freely to encircle his neck, a neck dam in the form of a sleeve extending downwardly through said first ring with its upper end overlying said first ring, said second ring overlying said upper dam end and detachably attached to said first ring and clamping said dam end therebetween, said first ring having an external channel over which both the collar of the suit and the helmet dam extends and clamping means encircling said first ring and securing said collar and neck dam in said channel.

2. The diving suit of claim 1 in which the collar of the suit includes an outwardly disposed bead at its upper end and a shoulder portion and the bead is in engagement with the upper side wall of the channel.

3. The diving suit of claim 2 in which the side walls of the neck seal channel are outwardly inclined away from each other and the margin of the shoulder portion abutting the neck is seated against the lower side wall.

4. The diving suit of claim 1 in which the first and second rings are elliptical.

5. A neck seal for a diving suit having a collar and a helmet having a dam, said neck seal including first and second rings dimensioned to permit the head of the wearer to pass freely therethrough and freely to encircle the neck of the wearer, a neck dam in the form of a sleeve extending downwardly through the first ring overlying said upper dam end and detachably attached to said first ring and clamping the interposed dam end therebetween, said first ring including an external channel, and clamping means including a band encircling said channel and adapted to clamp said collar and the helmet dam thereto when overlying said first ring, one overlapping the other.

6. The neck seal of claim 5 in which the upper end of the neck dam is an outwardly disposed flange.

7. The neck seal of claim 5 in which the walls of the channel are outwardly inclined away from each other and the depth of the channel is such as to accommodate the combined thickness of the collar and helmet dam.

8. The neck seal of claim 5 in which the neck dam includes an upper portion of uniform cross sectional size and shape provided with an outwardly disposed flange and a lower portion that is downwardly and inwardly inclined.

9. The neck seal of claim 5 in which both neck rings are elliptical.

10. The neck seal of claim 9 in which the upper portion of the neck dam is also elliptical.

* * * * *